US012384651B2

(12) United States Patent
Roa-Quispe et al.

(10) Patent No.: US 12,384,651 B2
(45) **Date of Patent: *Aug. 12, 2025**

(54) STACKABLE SPOOL CABLE MANAGER

(71) Applicant: BELDEN CANADA ULC, Saint-Laurent (CA)

(72) Inventors: Christian Roa-Quispe, Laval (CA); Oscar Alberto Lazarte Barrios, Montreal (CA)

(73) Assignee: BELDEN CANADA ULC, Saint-Laurent (CA)

( * ) Notice: Subject to any disclaimer, the term of this patent is extended or adjusted under 35 U.S.C. 154(b) by 0 days.

This patent is subject to a terminal disclaimer.

(21) Appl. No.: 18/434,498

(22) Filed: Feb. 6, 2024

(65) Prior Publication Data

US 2024/0174481 A1 May 30, 2024

Related U.S. Application Data

(63) Continuation of application No. 17/545,626, filed on Dec. 8, 2021, now Pat. No. 11,891,267.

(60) Provisional application No. 63/122,552, filed on Dec. 8, 2020.

(51) Int. Cl.
*B65H 75/22* (2006.01)
*B65H 75/24* (2006.01)

(52) U.S. Cl.
CPC ..... *B65H 75/2272* (2021.05); *B65H 75/24* (2013.01); *B65H 2402/10* (2013.01)

(58) Field of Classification Search
CPC .... B65H 75/12; B65H 75/2272; B65H 75/24; B65H 2402/10; B65H 75/4473; B65H 75/446; B65H 2701/526; B65H 2701/534
See application file for complete search history.

(56) References Cited

U.S. PATENT DOCUMENTS

| | | | | |
|---|---|---|---|---|
| 5,724,469 | A | 3/1998 | Orlando | |
| 5,727,752 | A | 3/1998 | Matsuzoe | |
| 5,803,401 | A | 9/1998 | Matsuzoe | |
| 6,481,662 | B1 | 11/2002 | Kles et al. | |
| 6,612,515 | B1 | 9/2003 | Tinucci et al. | |
| 6,814,328 | B1 | 11/2004 | Li et al. | |
| 7,684,670 | B2 | 3/2010 | Tsutsumi et al. | |
| 8,750,668 | B2 | 6/2014 | Chu | |
| 8,831,394 | B2 | 9/2014 | Kimbrell et al. | |
| 9,274,301 | B2 | 3/2016 | Her | |
| 9,581,783 | B2 | 2/2017 | Gilbreath et al. | |
| 9,678,299 | B2 | 6/2017 | Wells et al. | |
| 10,928,602 | B2 | 2/2021 | Haile-Mariam et al. | |
| 11,320,616 | B2 | 5/2022 | Al Ghossein | |
| 11,891,267 | B2 * | 2/2024 | Roa-Quispe ..... | B65H 75/24 |
| 2013/0200193 | A1 | 8/2013 | Lichoulas et al. | |
| 2014/0027558 | A1 | 1/2014 | Kawauchi et al. | |

* cited by examiner

*Primary Examiner* — William A. Rivera
(74) *Attorney, Agent, or Firm* — MH2 Technology Law Group, LLP

(57) ABSTRACT

A stackable spool cable manager assembly may include a plurality of like cable manager spools. The cable manager spools may include a locking mechanism such that the cable manager spools can be stacked and such that when locked together a cable support arm of each the cable manager spools is offset from the others. A magnet may also be provided, for example, for securing to a bottom one of a stack of cable manager spools such that they can be secured to a metal tray or the like.

20 Claims, 7 Drawing Sheets

STACKABLE SPOOL CABLE MANAGER

CROSS REFERENCE TO RELATED APPLICATIONS

This application is a continuation of U.S. patent application Ser. No. 17/545,626, filed on Dec. 8, 2021, which claims benefit, under 35 U.S.C. § 119(e) of U.S. provisional application Ser. No. 63/122,552 filed on Dec. 8, 2020 and which is incorporated herein in its entirety by reference.

FIELD OF THE INVENTION

The present invention relates to a stackable spool cable manager.

BACKGROUND TO THE INVENTION

The present invention relates to a stackable spool cable manager.

SUMMARY OF THE INVENTION

According to various exemplary aspects of the disclosure, a stackable spool cable manager assembly for mounting on a surface manufactured from a ferrous material may include a plurality of like cable manager spools. Each of the cable manager spools may include a center portion having an outer surface, a top surface, and a bottom surface opposite the top surface, a locking mechanism including a first part on the top surface and a second part in a bottom surface, a support arm extending away from the center portion and having a cable support surface and an end stop attached to an outer end of the cable support surface, and a magnet. The first part may be configured to engage with the second part and such that an upper one of the plurality of cable manager spools may be engageable with an adjacent lower one of the plurality of cable manager spools. The support arm of each of the cable manager spools may be positioned such that on securing of the lower cable manager spools to the upper cable manager spools, a support arm of the lower cable manager spools may be offset from a support arm of the upper cable manager spool, and the magnet may be positioned in a bottom one of the plurality of cable manager spools such that when positioned on the tray, the magnet secures the plurality of like cable manager spools to the tray.

According to various exemplary embodiments of the disclosure, a cable manager spool may include a center portion having a cylindrical outer surface, a flat top surface, and a flat bottom surface in parallel to the top surface, a locking mechanism including a first part on the top surface and a second part in a bottom surface and an orifice in the bottom surface, a support arm extending radially away from the center portion and having a flat cable support surface wherein an underside of the flat cable support surface lies substantially in the same plane as the bottom surface, and an end stop. A lower long edge of the end stop may be attached to an outer end of the cable support surface such that the planar end stop is at a right angle to the cable support surface and at least one flat finger extends away from an upper long edge of the end stop towards the center portion and such that a flat under side of the at least one finger is coplanar and in parallel to the cable support surface. A magnet may be dimensioned to fit within the orifice.

DETAILED DESCRIPTION OF THE ILLUSTRATIVE EMBODIMENTS

Figure 1:
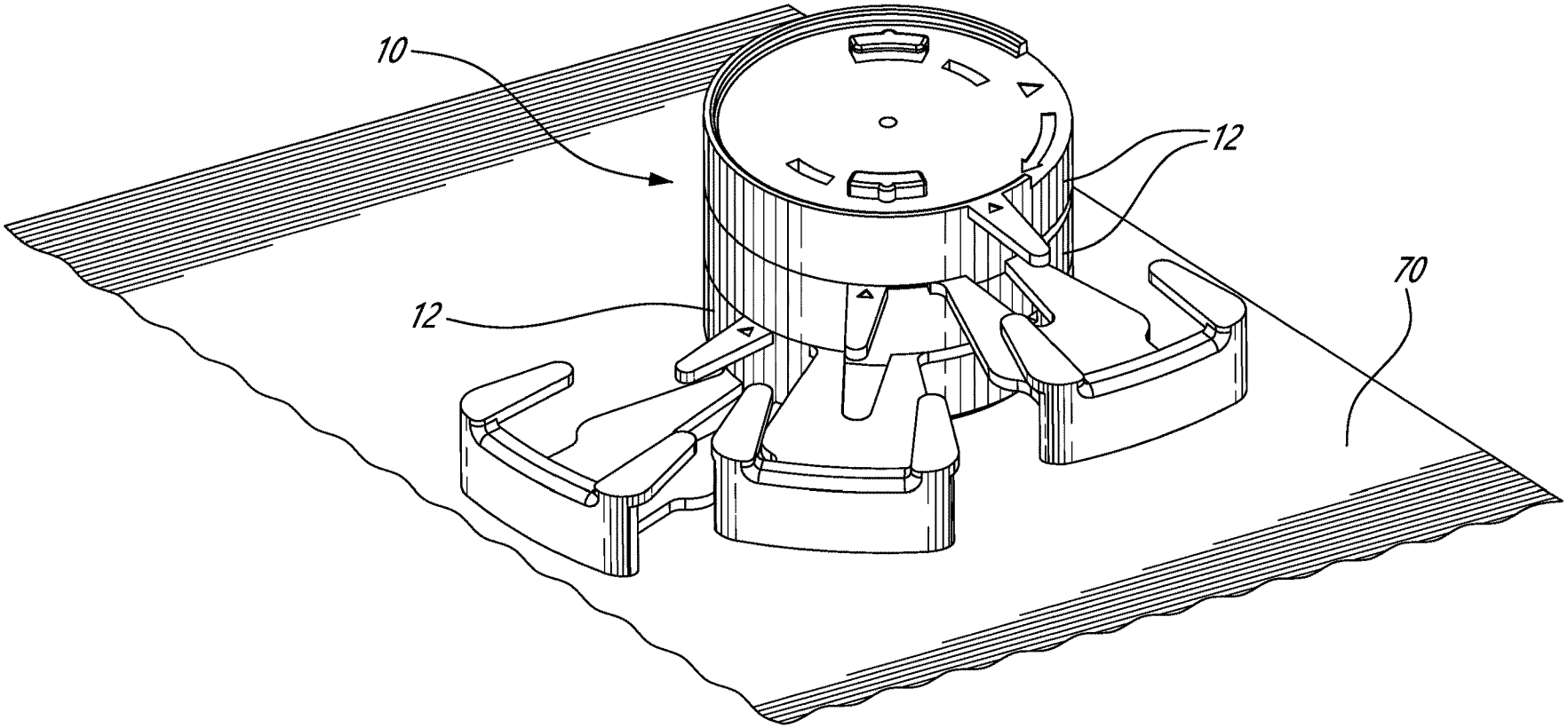
FIG. 1 provides a raised perspective view of cable spool manager assembly on a tray in accordance with an illustrative embodiment of the present invention.

Referring now to FIG. 1, a stackable spool cable manager assembly, generally referred to using the reference numeral 10, will now be described. The manager assembly 10 comprises a plurality of like cable spool managers 12 which are stacked on one another to form the manager assembly 10.

Figure 2:
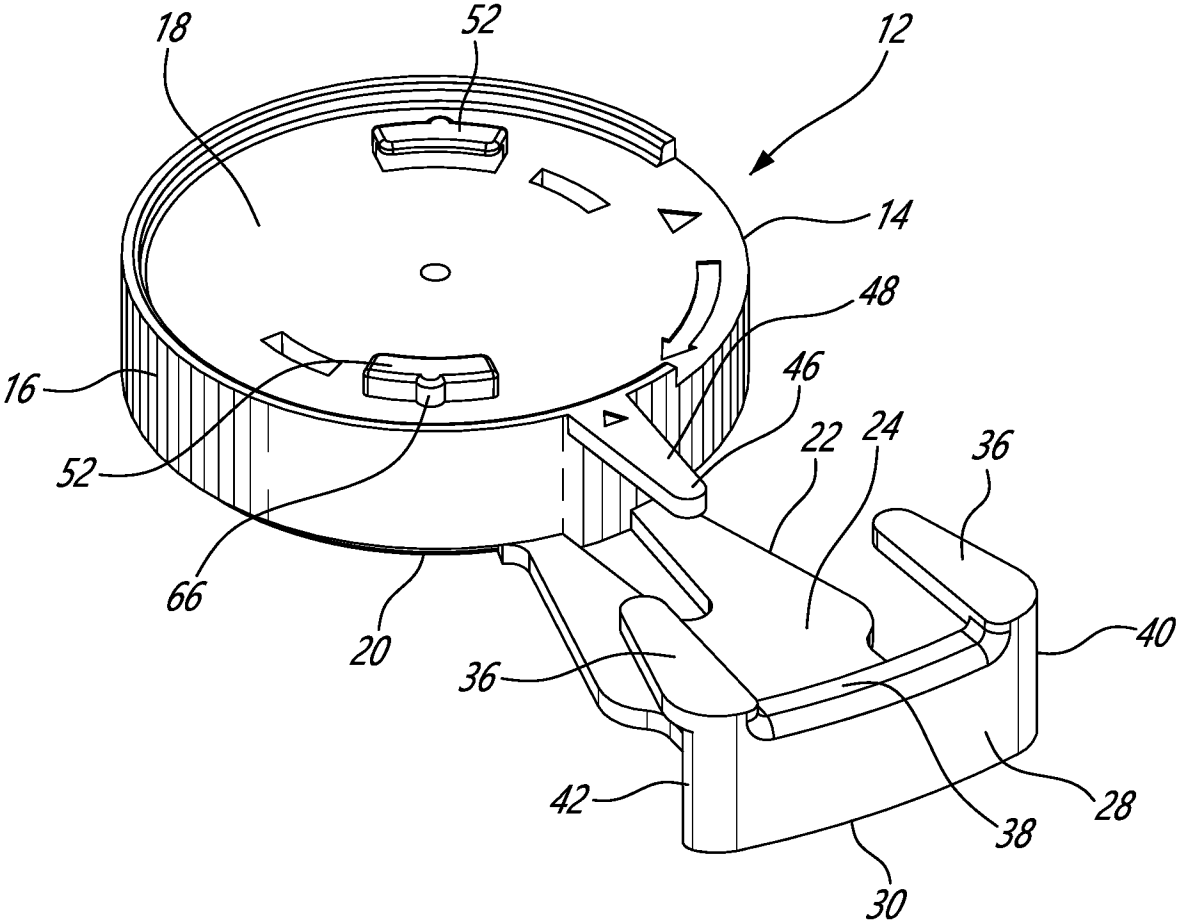
FIG. 2 provides a raised perspective view of cable spool manager in accordance with an illustrative embodiment of the present invention.
Figure 3:
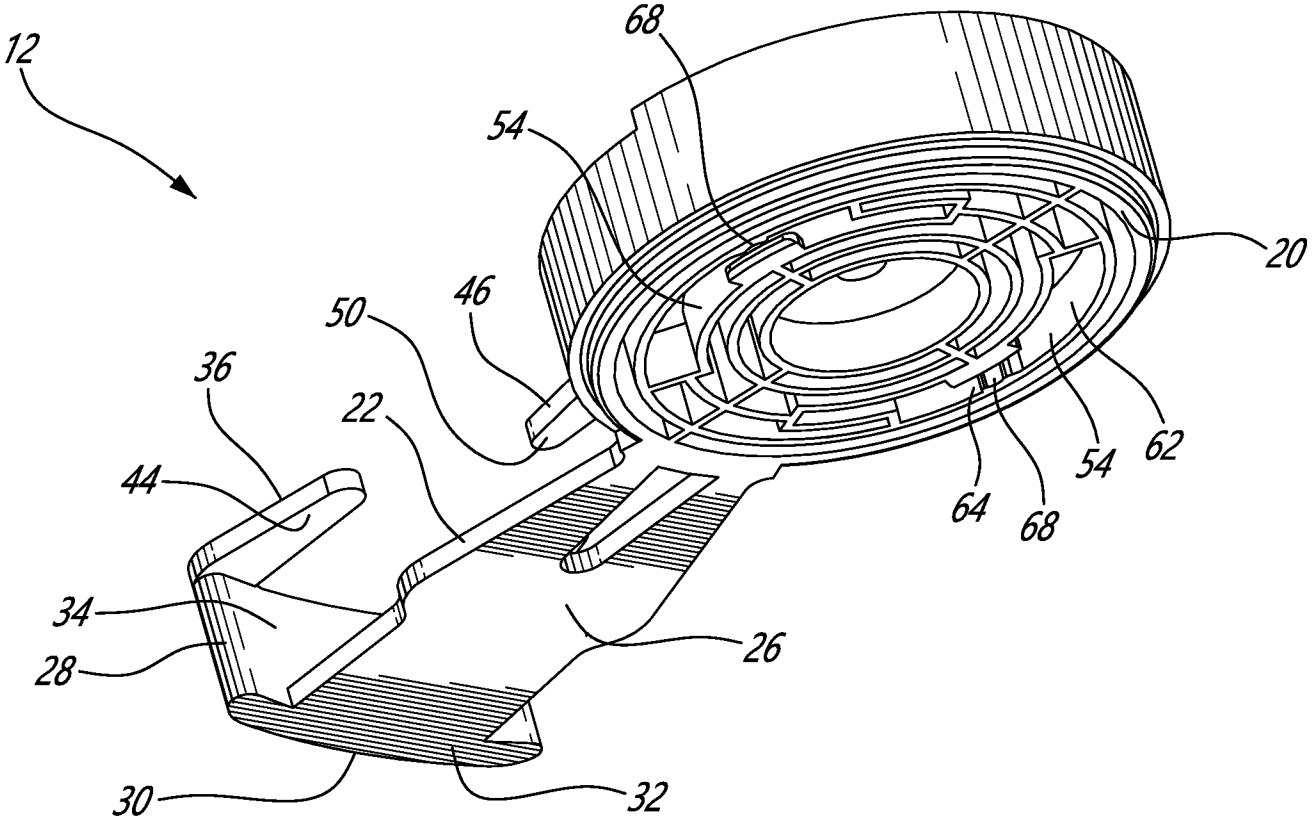
FIG. 3 provides a lowered perspective view of cable spool manager in accordance with an illustrative embodiment of the present invention.

Referring to FIG. 2 and FIG. 3, each cable spool manager 12 comprises a center portion 14 comprising a cylindrical outer surface 16, a flat top surface 18 and a flat bottom surface 20 arranged in parallel to the top surface 18. A support arm 22 extends radially outward from the cylindrical outer surface 16 and comprises a flat cable support surface 24. An underside 26 of the cable support surface 24 lies substantially in the same plane as the bottom surface 20. An elongate end stop 28 is attached along a lower long edge 30 to an outer end 32 of the cable support surface 24 and such that a curved surface 34 of the end stop 28 is arranged at right angles to the cable support surface 24. Additionally, a center of radius of curvature of the curved surface 34 of the end stop 28 is concentric with a radius of curvature of the center portion 14.

Still referring to FIG. 2 and FIG. 3, a pair of elongate fingers 36 extend away from an upper long edge 38 of the end stop 28 towards the center portion 154. Each finger 36 is positioned towards a respective end 40, 42 of the end stop 28. A flat underside 44 of each of the fingers 36 is flat and coplanar, and the underside 44 arranged in parallel to the flat cable support surface 24. A third substantially flat finger 46 is provided extending from the center portion 14 and aligned radially with the flat cable support surface 24. An upper surface 48 of the third finger 46 lies in substantially the same plane as the top surface 18 and an underside 50 of the third finger 46 lies opposite and in parallel to the flat cable support surface 24 and in the same plane as the underside 44 of each of the pair of fingers 36. The flat cable support surface 24, the undersides 44 of the pair of fingers 36 and the underside 50 of the third finger 46 together define a cable receiving region.

Still referring to FIG. 2 and FIG. 3, the center portion 14 further comprises a locking mechanism comprising a plurality of L-shaped tabs 52 extending from the top surface 18 and a corresponding plurality of tab receiving slots 54 molded or otherwise formed in the bottom surface 20.

Figure 4A:
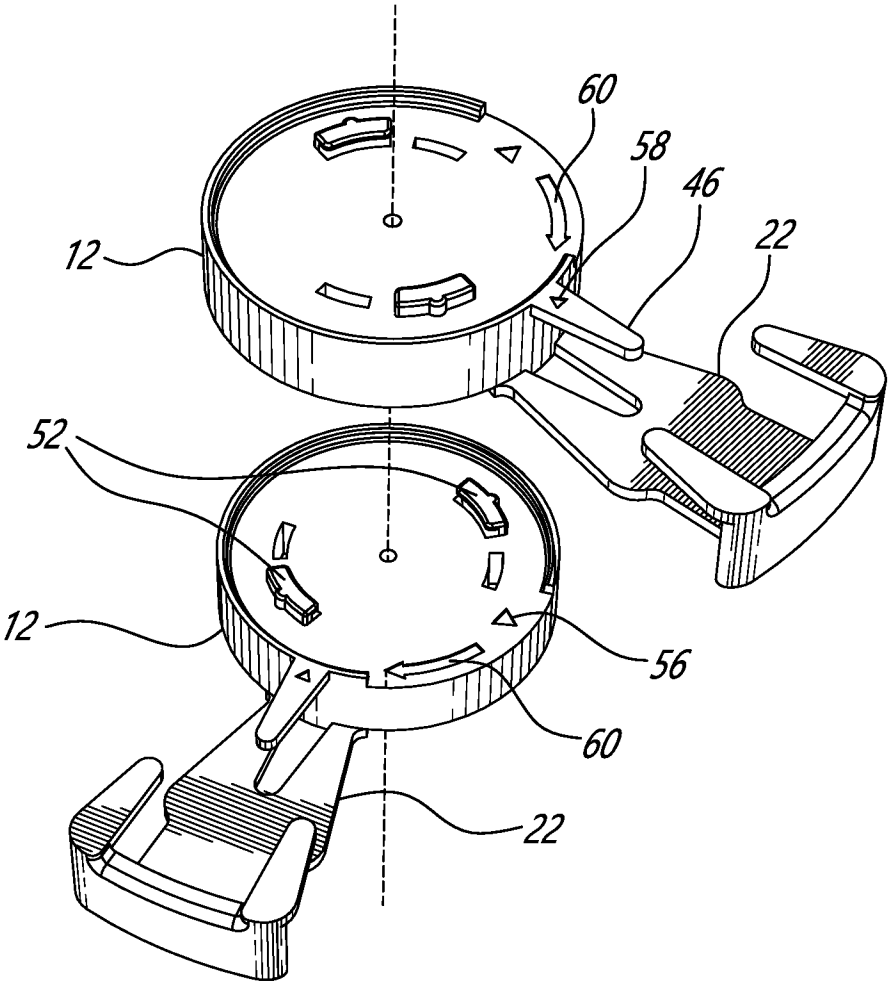
FIG. 4A provides a raised perspective view of a pair of disassembled cable spool managers in accordance with an illustrative embodiment of the present invention.

Referring now to FIG. 4A in addition to FIG. 3, in order to assemble the like cable spool managers 12 to form an assembly 10, a lower one of the cable spool managers 12 is concentrically aligned with an upper one of the cable spool managers 12 and such that a guide arrow 56 of the lower one of the cable spool managers 12 is aligned with a guide arrow 58 on the third finger 46 of the upper one of the cable spool managers 12 and such that their respective support arms 22 are arranged substantially at right angles. In this orientation the L-shaped tabs 52 of the lower one of the cable spool managers 12 are aligned with respective ones of the plurality of tab receiving slots 54.

Figure 4B:
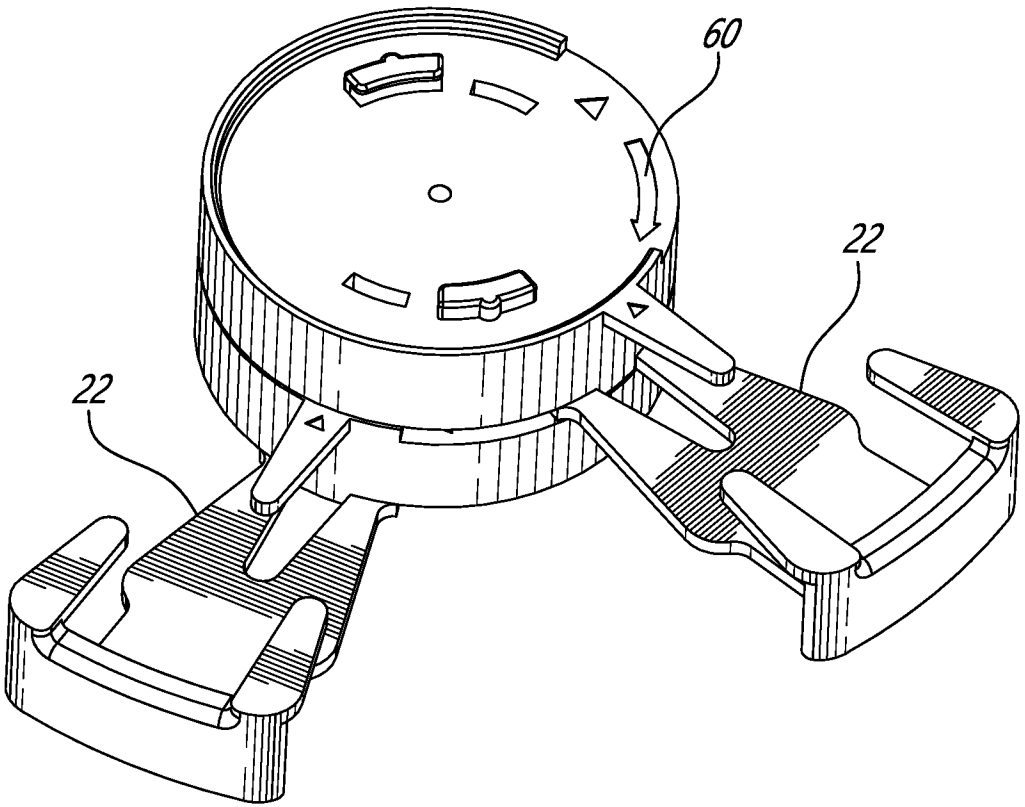
FIG. 4B provides a raised perspective view of a pair of partially assembled cable spool managers in accordance with an illustrative embodiment of the present invention.

With reference now to FIG. 4B in addition to FIG. 3 and FIG. 4A, the L-shaped tabs 52 of the lower one of the cable spool managers 12 are then inserted into their respective tab receiving slots 54 and the lower cable spool manager 12 rotated relative to the upper cable spool manager 12 and in accordance with the direction indicated by an assembly arrow 60. In this regard, each of the tab receiving slots 54 comprises a wider slot part 62 and a narrower slot part 64.

Figure 4C:
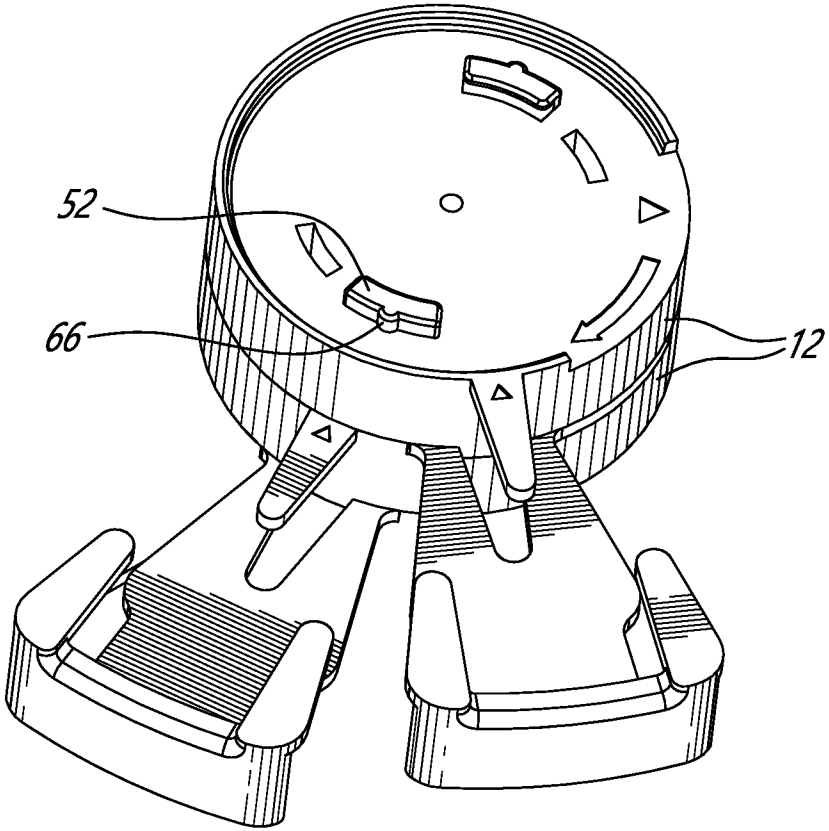
FIG. 4C provides a raised perspective view of a pair of assembled cable spool managers in accordance with an illustrative embodiment of the present invention.

As shown in FIG. 4C, as the lower cable spool manager 12 is rotated relative to the upper cable spool manager 12 each of the L shaped tabs 52 moves from the wider slot part 62 to the narrower slot part 64 and such that the bottom surface 20 of the upper cable management spool is gripped by each of said L-shaped tabs 52. With reference back to FIG. 3 in addition to FIG. 4C, as the lower cable spool manager 12 is rotated relative to the upper cable spool manager 12 into the assemble position, a boss 66 on each of L shaped tabs 52 is engaged by complementary features 68 adjacent each narrower slot part 64 and such that the lower cable spool manager 12 is releasably secured to the upper cable spool manager 12 in the assembled position.

Figure 5:
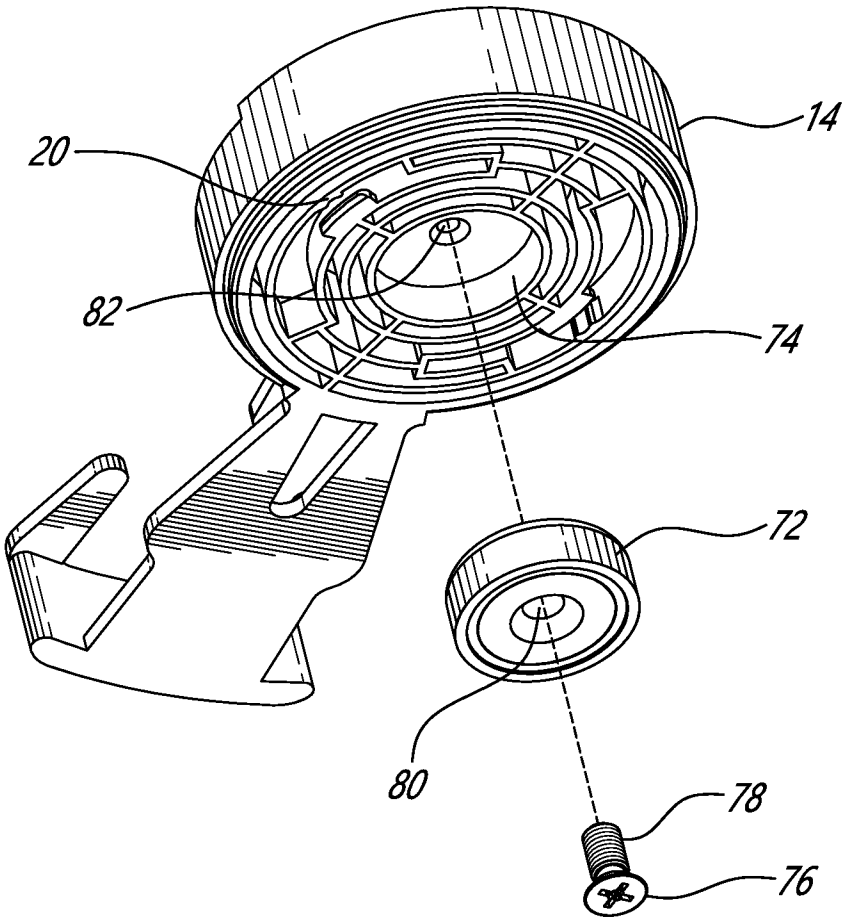
FIG. 5 provides an exploded lowered perspective view of cable spool manager and magnet in accordance with an illustrative embodiment of the present invention.

Referring now to FIG. 5 in addition to FIG. 1, in order to secure the stackable spool cable manager assembly 10 to a tray 70 or the like manufactured from a ferrous material, a disk-shaped magnet 72 may be secured to the bottom surface 20. In this regard, an annular magnet receiving orifice 74 is provided concentric with the center portion 14. The magnet 72 is illustratively secured within the orifice 74 using a bolt 76, a threaded end 78 of which is inserted through a bore 80 in the magnet 72 and engaged in a complementary threaded bore 82 in the center portion 14.

Although the present invention has been described hereinabove by way of specific embodiments thereof, it can be modified, without departing from the spirit and nature of the subject invention as defined in the appended claims.

The invention claimed is:

1. A spool cable manager configured to maintain minimum curve bend radius of fiber optic cables, comprising:

a cylindrical center portion comprising a top surface and a bottom surface opposite the top surface and a locking portion comprising a first locking portion on the top surface and a second locking portion on the bottom surface;

a single support portion extending radially outwards from the bottom surface and comprising an end stop portion and a flat cable support portion between the end stop portion and the cylindrical center portion;

wherein the first locking portion comprises a first plurality of engaging portions on the top surface and spaced along a first path concentric with the cylindrical center portion;

wherein the second locking portion comprises a second plurality of engaging portions on the bottom surface and spaced along a second path concentric with the cylindrical center portion and in parallel to the first path;

wherein the spool cable manager comprises a first cable manager spool that is configured to engage a like second cable manager spool;

wherein the first plurality of engagement portions comprises a plurality of L-shaped tab portions that each extend from the top surface and are spaced along the first path, the second plurality of engagement portions comprises a plurality of tab receiving slot portions that extend from the bottom surface and are spaced along the second path, and the first cable manager spool is configured to be secured to the like second cable manager spool when one of the plurality of L shaped tab portions of the first cable manager spool engage a respective one of the plurality of tab receiving slot portions of the second cable manager spool; and wherein the single support portions of the first and second cable manager spools are structurally configured to be offset axially from one another so as to manage lengths of fiber optic-cables in high-density applications while maintaining minimum curve bend when the first and second cable manager spools engage each other.

2. The spool cable manager of claim 1, wherein the bottom surface portion of the second cable management spool is configured to form a gripped portion with at least one of the L-shaped tab portions of the first cable manager spool when the first cable manager spool is rotate relative to the second cable manager spool.

3. The spool cable manager of claim 1, further comprising a magnet portion configured to magnetically maintain an engagement portion between the first and second cable manager spools.

4. The spool cable manager of claim 3, wherein the spool cable manager is configured for installation on a networking equipment and wherein the magnet portion is positioned in at least a portion of the bottom surface so as to be configured to magnetically secure the first cable manager spool to a metal portion of the networking equipment.

5. The spool cable manager of claim 1, wherein the end stop portion is arranged at a right angle to the flat cable support portion so as to retain the different lengths of fiber optic-cables on the flat cable support portion during operation.

6. The spool cable manager of claim 1, wherein the single support portion is fixedly mounted to the cylindrical center portion such that the single support portion does not move relative to cylindrical center portion during operation.

7. A spool cable manager, comprising:

a cable manager spool that is configured to be secured to a second cable manager spool when a locking portion of the first cable manager spool engages a second locking portion of the second cable manager spool;

wherein the cable manager spool is structurally configured to be secured to the second cable manager spool by receiving the locking portion into the second locking portion and then rotating the cable manager spool relative to the second cable manager spool; and wherein a support portion of the cable manager spool is structurally configured to be offset axially from a second support portion of the second cable manager spool when the cable manager spool is secured to the second cable manager spool so as to provide support to different lengths of fiber optic-cables in high-density applications while maintaining minimum curve bend radius of each of the different lengths of fiber optic cables.

8. The spool cable manager of claim 7, wherein the locking portion is configured to engage the second locking portion by arranging a cylindrical center portion of the cable manager spool so as to axially align with a second cylindrical center portion of the second cable manager spool.

9. The spool cable manager of claim 8, wherein the locking portion comprises a plurality of locking portions extending from at least a portion of a top surface of the cylindrical center portion, and the second locking portion comprises a second plurality of locking portions each extending along at least a portion of a bottom surface of the second cylindrical center portion.

10. The spool cable manager of claim 9, wherein the plurality of engaging portions are spaced along a first path concentric with the cylindrical center portion and the second plurality of engaging portions are spaced along a second path concentric with the second cylindrical center portion and in parallel to the first path.

11. The spool cable manager of claim 7, wherein the cable support portion is flat shaped so as to provide a surface for the different lengths of fiber optic-cables to rest on during operation.

12. The spool cable manager of claim 7, wherein the cable support portion extends between the cylindrical center portion and an end stop portion.

13. The spool cable manager of claim 7, further comprising a magnet configured to magnetically maintain a magnetic engagement portion between the cable manager spool and the second cable manager spool.

14. A cable manager comprising:

a cable support manager comprising a center portion and a support portion fixedly extending from the center portion;

wherein the support portion defines a cable receiving portion having a cable support portion extending from the center portion to a bottom portion of an end stop portion and a projecting portion extending from a top portion of the end stop portion partially to the center portion to provide an open upper portion of the cable receiving portion; and wherein the cable support manager is structurally configured to selectively engage a second cable support manager so as to manage a plurality of different lengths of fiber optic cable while maintaining a minimum curve bend radius of each of the plurality of different lengths of fiber optic cable.

15. The spool cable manager of claim 14, wherein the second cable support manager comprises a second center portion and a second support portion fixedly extending from the second center portion.

16. The spool cable manager of claim 14, wherein support portion of the cable manager spool is structurally configured to be offset axially from the second support portion of the second cable manager spool when the cable manager spool and the second cable manager spool engage each other.

17. The spool cable manager of claim 14, wherein the center portion of the cable manager comprises a first upward locking portion and a first downward locking portion, the second center portion of the second cable manager comprises a second upward locking portion and a second downward locking portion, and the cable manager spool and the second cable manager spool are configured to selectively lock with each other either when the first upward locking portion selectively locks with the second downward locking portion, or when the first downward locking portion selectively locks with the second upward locking portion.

18. The spool cable manager of claim 17, wherein the first upward locking portion is configured to selectively lock to the second downward locking portion by one of arranging the first upward locking portion opposite the second downward locking portion or the first downward locking portion opposite the second upward locking portion and rotating the cable manager spool relative to the second cable manager spool such that respectively the first upward locking portion selectively locks with the second downward locking portion or the first downward locking portion selectively locks with the second upward locking portion.

19. The spool cable manager of claim 18, wherein the first upward locking portion and the second upward locking portion each comprise a first plurality of locking portions and the first downward locking portion and the second downward locking portion each comprise a second plurality of locking portions, wherein the first and second upward locking portions are configured to selectively lock with respective ones of the second and first downward locking portions when the cable manager spool and the second cable manager spool are selectively secured to each other.

20. The spool cable manager of claim 14, wherein the end stop portion is arranged at a right angle to the cable support portion so as to retain the different lengths of fiber optic-cables on the cable support portion during operation.

* * * * *